United States Patent [19]

Kitzmann et al.

[11] Patent Number: 4,694,130

[45] Date of Patent: Sep. 15, 1987

[54] ILLUMINATED PUSHBUTTON SWITCH WITH UNITARY SPRING AND CONTACT

[75] Inventors: Ronald A. Kitzmann; Sarkis K. Tchejeyan, both of Santa Barbara, Calif.

[73] Assignee: General Motors Corporation, Detroit, Mich.

[21] Appl. No.: 901,944

[22] Filed: Aug. 29, 1986

[51] Int. Cl.[4] ..... H01H 1/18; H01H 1/36; H01H 9/16

[52] U.S. Cl. ..... 200/314; 200/275; 200/241; 200/245; 200/159 A; 200/252

[58] Field of Search ..... 200/314, 159 A, 276, 200/284, 290, 241, 242, 245, 246, 250, 252, 253, 260, 275, 313

[56] References Cited

U.S. PATENT DOCUMENTS

| | | | |
|---|---|---|---|
| 2,546,086 | 3/1951 | Brockway | 200/314 |
| 2,850,601 | 9/1958 | Pratingson | 200/159 A |
| 3,309,697 | 3/1967 | Skrbina | 200/314 X |
| 3,467,802 | 9/1969 | Martin | 200/314 |
| 3,949,181 | 4/1976 | Kempf | 200/241 X |
| 4,016,388 | 4/1977 | Golbeck et al. | 200/314 |
| 4,088,855 | 5/1978 | Emery | 200/314 X |
| 4,092,503 | 5/1978 | Raeder | 200/314 X |
| 4,220,835 | 9/1980 | Storz et al. | 200/159 A |
| 4,434,338 | 2/1984 | Rood | 200/276 |

*Primary Examiner*—Stephen Marcus
*Assistant Examiner*—Ernest G. Cusick
*Attorney, Agent, or Firm*—Warren D. Hill

[57] ABSTRACT

An illuminated pushbutton switch has a translucent button aligned with a lamp, a stationary contact, and a sinuous spring urging the button to its released position, the spring being bifurcated and straddling the lamp to allow a clear illumination path. The spring serves as the movable contact of the switch and engages the stationary contact when the button is depressed.

6 Claims, 4 Drawing Figures

ILLUMINATED PUSHBUTTON SWITCH WITH UNITARY SPRING AND CONTACT

FIELD OF THE INVENTION

This invention relates to an illuminated pushbutton switch and particularly to such a switch having a unitary movable contact and button return spring arranged to facilitate good illumination of the push button.

BACKGROUND OF THE INVENTION

Typical pushbutton switches have a movable button urged away from a base portion by a spring element and also have switch contacts which open or close upon button movement. In some cases it has been proposed that the spring element serve as one of the switch contacts. Often it is desired to provide a switch with an interior lamp for illumination of the push button. The design of the switch then becomes more complicated since the lamp and its ability to properly illuminate the button must be considered. Prior illuminated switches have often suffered from the contact or spring structure interfering with the light path and restricting the area of illumination on the button. One solution has incorporated the lamp in the movable button rather than on the stationary base, but that design results in a bulky button and the need for an electrical circuit connection to the movable lamp. An improved open spring structure allowing good illumination of a movable button from a stationary lamp is thus desirable. In addition, for the sake of reliability and ease of manufacture it is desirable to maintain a simple design with a minimum number of parts.

SUMMARY OF THE INVENTION

It is therefore an object of the invention to provide an illuminated pushbutton switch with a simple design and a minimum number of parts and affording a large illuminated area of the push button.

BRIEF DESCRIPTION OF THE DRAWINGS

The above and other advantages of the invention will become more apparent from the following description taken in conjunction with the accompanying drawings wherein like reference numerals refer to like parts and wherein.

DESCRIPTION OF THE PREFERRED EMBODIMENT

The invention is carried out by an illuminated pushbutton switch comprising; a base, a push button mounted for telescoping movement relative to the base between released and depressed states for switch operation, a cap on the push button spaced from the base, a lamp on the base for illuminating the cap, a stationary contact secured to the base and extending toward the push button cap, and a unitary movable contact and spring means secured at one end to the base and having a pair of spaced sinuous portions compressed in the space between the base and the push button cap and engaging the cap at its margins to spring load the push button away from the base and to allow illumination of the caps within the margins, the movable contact having an integral part adjacent and spaced from the stationary contact in one state and moving in response to push button movement so that it is pressed into engagement with the stationary contact in the other state.

Figure 1:
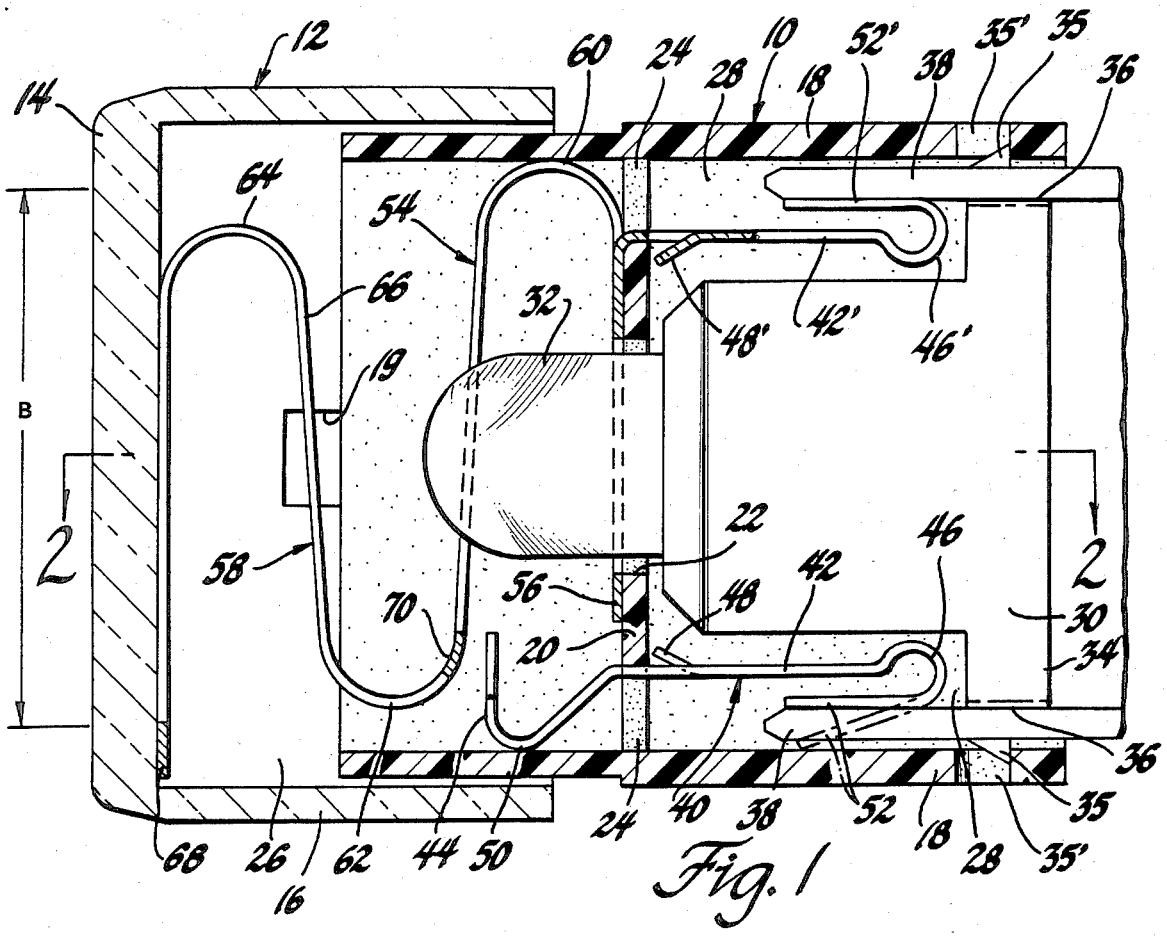
FIG. 1 is a cross-sectional view of a switch according to the invention.
Figure 2:
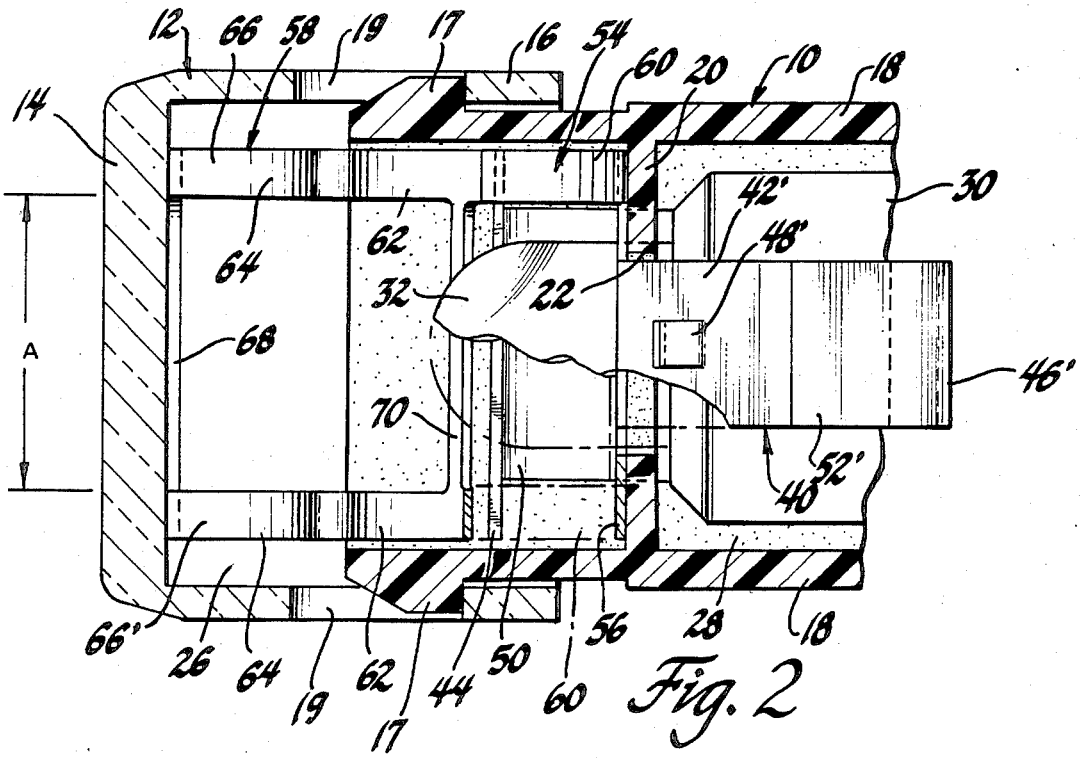
FIG. 2 is another cross-sectional view of the switch of FIG. 1 taken along lines 2—2.

Referring to the FIGS. 1 and 2, a switch assembly includes a base 10 of generally rectangular cross-section and a push button 12 having a translucent cap 14 and a skirt 16 slightly larger than and shaped like the base 10 and disposed in a freely sliding telescoping relationship with the base 10. Projections 17 laterally extending from the base 10 slidably engage slots 19 in the skirt 16 to limit outward movement of the button 12. The translucent cap 14 is particularly intended to be illuminated from within the switch assembly and may bear a legend in its central region. Dimensions A and B indicate the extent of the illuminated area which is suitable for a legend. The base is essentially hollow thereby defining exterior walls 18 and contains a transverse web 20 provided with a central lamp-receiving aperture 22 and a pair of lateral slots 24 adjacent the walls. The web 20 divides the base into a spring chamber 26 which has one side defined by the push button 12 and a bulb housing chamber 28.

A bulb housing 30 fits within the chamber 28 and supports a bulb or lamp 32 which protrudes through the aperture 22 into the chamber 26 in a location suitable to illuminate the push button cap 14. The bulb housing 30 has a flange 34 which closes the chamber 28. Lateral projections 35 on the flange engage apertures 35' in the wall 18 to secure the bulb housing 30. A pair of slots 36 in opposite sides of the flange 34 admit blades 38 of an electrical plug (not shown) to the interior of the chamber 28. Additional blades (not shown) supply current to the lamp.

A stationary contact 40 formed of flat stock of beryllium copper extends through one of the slots 24 and comprises a long shark 42 residing primarily in the chamber 28 and includes a hook-shaped contact portion 44 at one end in the spring chamber 26 and a return bend spring portion 46 at the other end in the other chamber 28. A locking tang 48 bent out from the shank 42 engages a surface of the web 20 to hold the contact against axial movement in one direction. A bend 50 in the portion 44 engages the wall 18, the shank 42 engages the web 20 at a point spaced from the wall 18, and the end 52 of the spring portion 46 engages the wall 18 (as shown in broken lines) so that the contact 40 is held securely in the base. When the blades 38 are inserted into the switch assembly, one of the blades slides between the wall 18 and the end 52 (as shown in solid lines) so that the end 52 lies parallel to the shank 42 and is flush with the blade.

The movable contact 54 has an end portion like the stationary contact with counterparts shank 42', spring portion 46', tang 48', and end 52'. In the spring chamber 26 the contact 54 has a flat part 56 seated against the web and containing an aperture for the lamp 32. A sinuous bifurcated spring portion 58 emanates from an edge of the flat part 56 and has a first bend 60 engaging the wall 18 to secure the contact to the base in the same manner as the contact 40. A second bend 62 of the spring portion occurs on the side of the chamber 26 opposite the bend 60 and adjacent the hooked-shaped portion 44 of the stationary contact. A third bend 64 in the sinuous spring 58 occurs on the same side of the chamber 26 as the first bend 60 and terminates in a flat portion which lies flush against the inner surface of the cap 14 and is parallel to the flat part 56. In the button-released position each bend subtends an angle of nearly 180° and the bends are connected by straight sections which are more or less parallel to the flat part. The two sides or legs 66 and 66' of the bifurcated springs are thin and widely spaced, disposed at opposite sides of the chamber 26, so that the opening between them provides a clear path for light from the lamp 32 to reach the cap 14 for illumination of a large rectangular area. A first tie bar 68 connects the ends of the two sides 66 and 66' to maintain integrity of the spring 58. The legs and the tie bar 68 contacts the cap 14 at margins of the cap to leave a large unobstructed central rectangular area for legends. A second tie bar 70 for the same purpose connects the sides 66 and 66' on the second bend 62 at a place adjacent the portion 44 of the stationary contact. When the button 12 is depressed the tie bar 70 along with the associated part of the spring 58 moves into engagement with the portion 44 to close the switch. Thus the unitary contact 54 serves a spring function for button return to released position as well as a movable contact function for switch operation.

Figure 3:
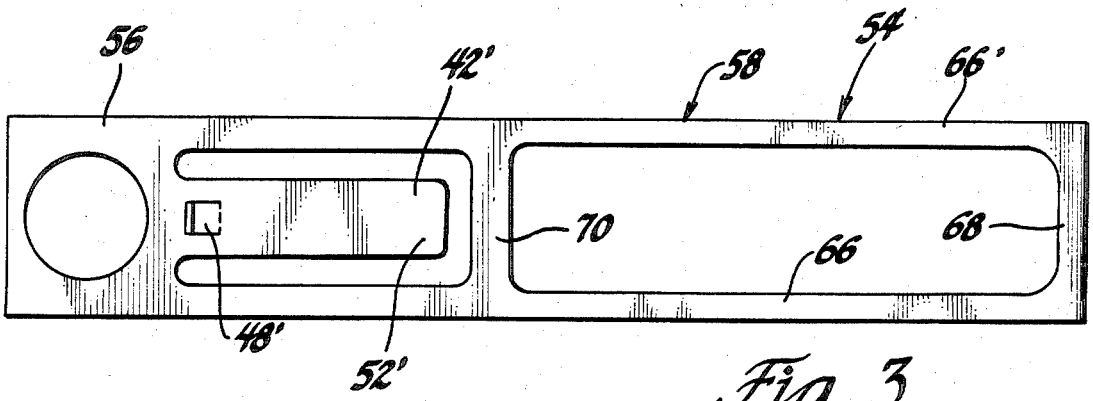
FIG. 3 is a flat layout of the unitary spring and contact element of FIG. 1.

The blank of flat beryllium copper material from which the movable contact 54 is formed is shown in FIG. 3. The corresponding parts 42', 48', 52', 56, 58, 66, 66', 68, and 70 of the finished part are indicated.

Figure 4:
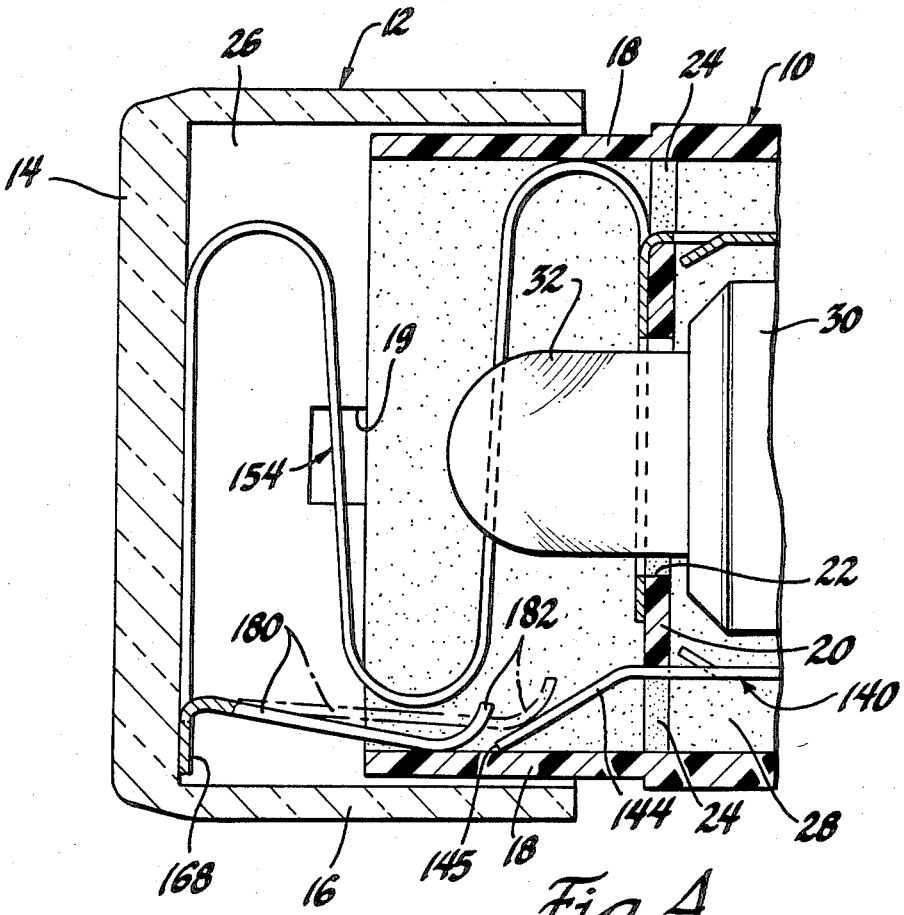
FIG. 4 is a cross-sectional view of a second embodiment of the switch according to the invention.

A second embodiment of the switch is shown in FIG. 4 which depicts those features which differ from the FIG. 1–3 embodiment. The stationary contact 140 terminates in a ramp 144 having an end 145 engaging the wall 18 in place of the hook-shaped end portion 44. The movable contact 154 does not make contact at the second tie bar but instead is provided with a leaf spring 180 depending from the first tie bar 168, extending toward the ramp 144 of the contact 140 and slidably engaging the inner side of the wall 18. The end of the leaf spring curves to form a rounded contact 182 for easily sliding along the ramp 144. When the push button 12 is in the released state the rounded contact 182 is spaced slightly from the ramp 144 so that no electrical connection is made. Upon depression of the button 12 the rounded contact 182 engages the ramp 144 in a wiping action which has a cleansing effect and completes an electrical circuit between the two contacts. This embodiment, in addition to providing the sliding contact, offers twice as much contact movement for a given button travel as does the first embodiment.

It will thus be seen that in either structure, according to this invention, the mechanism requires only two elements to accomplish both switching and spring return functions so that the switch is simple and easy to assemble. In either case, the open configuration of the spring allows the lamp to be easily accommodated in the switch assembly and provides a large clear region for the illumination of the push button.

The embodiments of the invention in which an exclusive property or privilege is claimed are defined as follows:

1. An illuminated pushbutton switch comprising a base, a pushbutton mounted for telescoping movement relative to the base between released and depressed states for switch operation, a cap on the pushbutton spaced from the base, a lamp on the base for illuminating the cap, a stationary contact secured to the base and extending toward the pushbutton cap, and a unitary movable contact and bifurcated spring means secured at one end to the base and having a pair of spaced sinuous portions each portion comprising a plurality of straight sections joined at bends and compressed between the base and the pushbutton cap and engaging the cap at the cap margins to spring load the pushbutton away from the base and to allow illumination of the caps within the margins, the movable contact and bifurcated spring means having an integral part adjacent and spaced from the stationary contact in one state and moving in response to pushbutton movement so that it is pressed into engagement with the stationary contact in the other state.

2. An illuminated pushbutton switch as defined in claim 1 wherein the integral part is a leaf spring suspended from a portion of the movable contact engaging the cap for movement through the same distance as the cap and, during movement of the push button toward the base, is pressed into sliding engagement with the stationary contact.

3. An illuminated pushbutton switch comprising a base, a pushbutton mounted for telescoping movement relative to the base between released and depressed states for switch operation, a cap on the pushbutton spaced from the base, a lamp on the base for illuminating the cap, a stationary contact secured to the base and extending toward the pushbutton cap, and a unitary movable contact and bifurcated spring means secured at one end to the base and having a pair of spaced sinuous portions each portion comprising a plurality of straight sections joined at bends and compressed between the base and the pushbutton cap and engaging the cap at the cap margins to spring load the pushbutton away from the base and to allow illumination of the caps within the margins, the sinuous portions each including a bend adjacent and spaced from the stationary contact in one state and pressed into engagement with the stationary contact in the other state.

4. An illuminated pushbutton switch comprising a base, a pushbutton mounted for telescoping movement relative to the base between released and depressed states for switch actuation, a cap on the pushbutton spaced from the base, a lamp on the base for illuminating the cap, a stationary contact secured to the base and extending toward the pushbutton cap, and a unitary movable contact secured at one end to the base, having another end engaging the cap margins, and having an intermediate bifurcated sinuous spring means compressed between the base and the pushbutton cap to spring load the pushbutton away from the base, the sinuous spring means comprising;

(a) a pair of spaced legs each having a plurality of bends coupled by straight sections for connecting the ends, and (b) a tie bar spanning the legs to stabilize the sinuous spring means and provide a contact surface spaced from the stationary contact in the released state and pressed into engagement with the stationary contact in the depressed state.

5. A pushbutton switch as defined in claim 4 including a second tie bar spanning the legs at the said another end contacting the cap margins.

6. An illuminated pushbutton switch comprising a base, a lamp mounted on the base, a translucent pushbutton mounted for telescoping movement relative to the base between released and depressed states for switch actuation, a translucent cap on the pushbutton spaced from the base and subject to light from the lamp, a stationary contact secured to the base and extending toward the pushbutton cap, and a unitary movable contact secured at one end to the base and having an intermediate sinuous spring means compressed between the base and the pushbutton cap and another end engaging the cap at the cap margins to spring load the pushbutton away from the base, the sinuous spring means comprising;

(a) a pair of spaced legs connecting the ends and straddling the lamp, each leg having a plurality of bends coupled by straight sections, and (b) a tie bar spanning the legs to stabilize the sinuous spring means and provide a contact surface spaced from the stationary contact in the released state and pressed into engagement with the stationary contact in the depressed state.

* * * * *